US007619232B2

(12) United States Patent
Schmidt et al.

(10) Patent No.: US 7,619,232 B2
(45) Date of Patent: Nov. 17, 2009

(54) METHOD AND DEVICE FOR PRODUCING EXTREME ULTRAVIOLET RADIATION OR SOFT X-RAY RADIATION

(75) Inventors: Martin Schmidt, Vanves (FR); Rainer-Helmut Lebert, Kelmis (BE); Uwe Stamm, Goettingen (DE)

(73) Assignees: XTREME Technologies GmbH, Goettingen (DE); Commissariat a l'Energie Atomique, Paris (FR); AIXUV GmbH, Aachen (DE)

( * ) Notice: Subject to any disclaimer, the term of this patent is extended or adjusted under 35 U.S.C. 154(b) by 709 days.

(21) Appl. No.: 10/562,496

(22) PCT Filed: Jun. 27, 2003

(86) PCT No.: PCT/EP03/09842

§ 371 (c)(1),
(2), (4) Date: Dec. 27, 2005

(87) PCT Pub. No.: WO2005/004555

PCT Pub. Date: Jan. 13, 2005

(65) Prior Publication Data

US 2008/0116400 A1 May 22, 2008

(51) Int. Cl.
*H05G 2/00* (2006.01)

(52) U.S. Cl. ..... 250/504 R; 250/503.1; 250/493.1

(58) Field of Classification Search ..... 250/504 R, 250/503.1, 493.1, 492.2; 378/119
See application file for complete search history.

(56) References Cited

U.S. PATENT DOCUMENTS

| | | | | |
|---|---|---|---|---|
| 5,577,092 | A | 11/1996 | Kublak et al. | |
| 6,064,072 | A | 5/2000 | Partlo et al. | |
| 6,389,106 | B1 | 5/2002 | Neff et al. | |
| 6,744,060 | B2 * | 6/2004 | Ness et al. | 250/504 R |
| 2005/0230645 | A1 * | 10/2005 | Melnychuk et al. | 250/504 R |

FOREIGN PATENT DOCUMENTS

| | | |
|---|---|---|
| WO | WO 99/34395 | 7/1999 |
| WO | WO 01/30122 | 4/2001 |
| WO | WO 02/32197 | 4/2002 |
| WO | WO 02 085080 | 10/2002 |
| WO | WO 02/091807 | 11/2002 |

* cited by examiner

*Primary Examiner*—Jack I Berman
*Assistant Examiner*—Hanway Chang
(74) *Attorney, Agent, or Firm*—Reed Smith LLP

(57) ABSTRACT

A device for generating extreme ultraviolet (EUV) or soft X-ray radiation comprising: a laser source for producing a laser radiation which is focused to intensities beyond $10^6$ W/cm$^2$ onto a target to produce a plasma; and said electrodes located around the path of the plasma produced by the laser source; and said electrodes being combined with components for producing a rapid electric discharge in the plasma with a characteristic time constant which is less than the time constant of the laser produced plasma expansion time.

29 Claims, 2 Drawing Sheets

METHOD AND DEVICE FOR PRODUCING EXTREME ULTRAVIOLET RADIATION OR SOFT X-RAY RADIATION

CROSS-REFERENCE TO RELATED APPLICATION

This application claims priority of International Application No. PCT/EP2003/009842, filed Jun. 27, 2003, the complete disclosure of which is hereby incorporated by reference.

BACKGROUND OF THE INVENTION a) Field of the Invention

The present invention relates to a method and device for producing extreme ultraviolet radiation (EUV) or soft X-ray radiation.

A preferred field of use of the present invention includes applications that require soft X-ray light, i.e. EUV light, in the 1-20 nm spectral range. The most prominent application is EUV projection lithography with an operating wavelength of 13.5 nm where compact, powerful, cost-efficient and reliable light sources are required. An additional field of applications includes X-ray analytic methods such as photo electron spectroscopy or fluoro-X-ray analysis which utilize the spectral range of soft X-ray radiation and which can be realized on a laboratory scale. Furthermore, the method and device can be utilized for the characterization of X-ray optics or X-ray detectors and finally as a source for an EUV microscope in the spectral range of the so-called water window for in vivo observation of biological tissues.

b) Description of the Related Art

The use of a plasma as a source for EUV light and soft and hard X-rays is well known. Nearly independent from the method of plasma generation, the emitting plasma has to be sufficiently hot (i.e. >150,000° K) and dense (i.e. $>10^{17}$ electrons/$cm^3$) to emit X-rays and/or EUV radiation.

Different techniques for producing EUV radiation are known that fulfill the above conditions. They can be divided into discharge based or laser based plasma source concepts.

For so-called gas discharge produced plasma (GDPP) sources, a pulsed discharge generates a "spark-like" plasma with currents of some 5 to 100 kA flowing through the plasma for times of some 10 nanoseconds to some microseconds. For increasing the conversion to EUV by additional heating and compression, the so-called pinch effect might contribute to the process. The different concepts of discharge plasmas differ in electrode geometry, voltage-pressure range, plasma dynamics, ignition strategies and in the electrical generator. Various examples of such discharge plasmas are known such as dense plasma focus Z-pinch discharge, capillary discharges and hollow cathode triggered pinch. Different versions of such discharge plasma concepts are disclosed in patent documents U.S. Pat. Nos. 6,389,106, 6,064,072 and WO 99/34395.

For so-called laser produced plasmas (LPP) a laser beam is focused to some dense ($>10^{19}$ atoms/$cm^3$) matter (most frequently called target). If intensities exceed some $10^{10}$ W/$cm^2$ EUV or even X-ray radiation is emitted from nearly any material. Various concepts using laser irradiated targets for plasma generation have been disclosed in patent documents WO02/085080, WO02/32197, WO 01/30122 and U.S. Pat. No. 5,577,092.

With common state of the art source concepts having maximum conversion efficiencies between 0.5 and 2%, typically 50,000 W to 100,000 W excitation power have to be coupled into the emitting plasma in order to obtain sufficient useful EUV power (80-120 W) for industrial applications such as EUV lithography. This translates into generation of 300 W up to more than 1,000 W of EUR radiation directly at the source spot, depending on the source concept. For the existing source concepts LPP and GDPP, several factors make it extremely difficult to satisfy these required EUV power levels:

1/For the LPP concepts, the limitation will be by two factors: First, it is expected that the costs of a laser with some 10 kW of power will by far exceed the budgets which are defined by economic production costs. Second, the electrical power needed to drive the laser (typically about one MW) and the required cooling will likely exceed acceptable scale at semiconductor factories.

2/For the GDPP concepts, the limitation is as follows. The power has to be fed into a volume of typically $10^3$ times the volume which emits the radiation. For a tolerable source volume of 1 $mm^3$ the typical discharge volume is of 1 $cm^3$. As the confinement of this volume is traditionally accomplished by either the discharge electrodes or by insulator material, these materials are heavily heated and eroded, because their typical distance from the hot plasma is allowed to be only in the order of some millimeters to centimeters.

Thus both laser produced plasma (LPP) and gas discharge produced plasma (GDPP) appear to be un-adapted to the latest requirements for industrial applications, in particular for extreme ultraviolet radiation lithography (EUVL). Consequently, an urgent demand for novel technical solutions arises which appears to be a condition sine qua non for the successful introduction of EUVL following the IRTS roadmap (2009) and Intel roadmap (2007).

OBJECTS AND SUMMARY OF THE INVENTION

It is therefore a primary object of the present invention to provide a method and a device which remedy the above-mentioned drawbacks of the two basic concepts of gas discharge produced plasma and laser produced plasma and enable in particular an application to EUV lithography in the spectral range around 13.5 nm under better economic conditions without the need for strongly increasing the power of the device used for producing the plasma whilst providing a high flexibility for adapting the device to the particular needs of the users.

The drawbacks of the prior art technologies are reduced whilst major advantages of such prior art technologies are retained due to unexpected synergistic effects which are used in the method and device according to the present invention.

The objects of the present invention are obtained through a method for generating extreme ultraviolet (EUV) or soft X-ray radiation wherein a plasma is generated and heated in a hybrid manner by the combination of a laser radiation produced by a laser source which is focused to intensities beyond $10^6$ W/$cm^2$ onto a target and of an electric discharge produced by electrodes combined with means for producing a rapid electric discharge, wherein the time constant of the laser produced plasma expansion time exceeds the characteristic time constant of the discharge.

The invention relates to a hybrid method that combines the generation and/or heating of a plasma with laser radiation and generation and/or heating and/or compressing of a plasma with a discharge in a way that the solution combines both concepts in a manner that the advantages of the single solution are combined, while the disadvantages of the known methods are avoided.

The target may be a gaseous, liquid, liquid spray, cluster spray or solid medium, such as a bulk or foil target, more than $10^{19}$ atoms/cm$^3$.

According to a first embodiment, an EUV plasma is first produced by the laser radiation focused on a dense target in a laser interaction zone and subsequently a discharge is induced in the laser interaction zone. It is important to note that the discharge will still efficiently couple energy into the EUV plasma even when the laser no longer couples to the plasma. For this reason, the discharge can be considered as a booster for the initial laser produced plasma thereby strongly enhancing EUV light production using cheap electrical power. This concept is called Discharge Boosted Laser Produced Plasma (DBLPP).

According to a second embodiment, a cold plasma is generated by the laser radiation focused on the target to produce a cold plasma plume and a discharge is then actively triggered in a delocalised interaction zone of the plasma plume to heat and compress the plasma for more confined EUV light emission. This concept is called Laser Assisted Gas Discharge Produced Plasma (LAGDPP).

According to a third embodiment, a high density discharge plasma is produced using a conventional discharge configuration.

However, during the pinch process, the plasma becomes sufficiently dense to allow locally for additional laser heating. This procedure allows to modify and/or optimise the population of ions to enhance EUV radiation (e.g. 13.5 nm for EUV lithography). This third concept is called Laser Boosted Gas Discharge Produced Plasma (LBGDPP).

From a general point of view, the three hybrid methods DBLPP, LAGDPP and LBGDPP presented above can be distinguished by:

(1) the respective contribution to plasma heating from the laser and the discharge in terms of energy injected to the EUV emitter plasma and the duration of excitation, (2) the time delay and chronological order of the two complementary heating mechanisms.

For both the GDPP and LPP concepts the elemental composition of the target is commonly chosen such that the emitted spectral distribution is best matched to the demands of the application. For the particular case of EUVL, the broad band emitter xenon is commonly considered as one of the most adapted material, because (1) it shows one of the highest conversion efficiencies within the spectral range of interest, (2) it is chemically neutral and (3) it is well heated with lasers because of its high Z. However, also other emitters like oxygen, lithium, tin, copper or iodine have been under investigation by either GDPP or LPP concepts.

The current pulses that are applied in the presence of plasma by the electrodes are provided by the rapid discharge of capacity stored energy.

The current pulses that are applied in the presence of plasma by the electrodes are selected with a period within a one to three-digit nanosecond range.

Advantageously, the current pulses that are applied in the presence of plasma by the electrodes are selected with amplitudes in a two-to-three digit kilo-ampere range.

The current pulses that are applied in the presence of plasma by the electrodes are switched in a defined temporal relation with the firing of the laser pulses produced by the laser source.

The plasma produced has a temperature in the six-digit Kelvin range (i.e. 100,000°-400,000° K).

The plasma is generated with gas pressures selected in the range below 10 Pa. The plasma emits radiation with wavelengths shorter than 50 nm.

The objects of the present invention are further obtained by a device for generating extreme ultraviolet (EUV) or soft X-ray radiation comprising a laser source for producing a laser radiation which is focused to intensities beyond $10^6$ W/cm$^2$ onto a target to produce a plasma, electrodes located around the path of the plasma produced by the laser source, the electrodes being combined with means for producing a rapid electric discharge in the plasma with a characteristic time constant which is less than the time constant of the laser produced plasma expansion time (being preferably in the order of 200 ns or less).

The means for producing a rapid electric discharge may comprise means for storing electrical energy like a capacity bank 131, or a pulse compressor 132.

In the case where a capacity bank 131 is used, the electrodes may be connected directly to that capacity bank 131 to produce the rapid electric discharge.

Alternatively the electrodes are connected to the capacity bank 131 through a power on-off switch 133 which is switched on by a logic control element 134, to produce said rapid electric discharge.

The discharge time of the electrodes is beyond 100 ns and 200 ns whereas the laser pulse duration of the laser pulses generated by the laser source is a few nanoseconds and does not exceed 60 ns.

According to a specific embodiment of the invention particularly advantageous in conjunction with the first embodiment (DBLPP), the device comprises a nozzle for injecting a cold jet target such as a micro-liquid jet, a spray target, a cluster target or an effusive gas target into a joint vacuum chamber equipped by at least one electrically insulating block to hold the electrodes around a laser interaction zone of the target.

The electrically insulating block presents a high thermal conductivity and is preferably cryogenically cooled, thereby allowing evacuating the heat load produced by absorption of both unused in-band and out-of-band radiation.

The electrically insulating block may further act as a heat shield for a cryogenic target injector pinch 21, star pinch or capillary discharge configuration.

According to a first embodiment, the device comprises a laser source for producing a laser radiation which is focused to intensities beyond $10^6$ W/cm$^2$ onto a dense target to produce a plasma.

According to a second embodiment, a laser beam produced by the laser source irradiates a solid bulk, solid foil, liquid, spray, cluster or effusive gas target to produce a cold plasma plume and the discharging electrodes are arranged on the path of the plasma plume with the laser interaction zone, the discharging electrodes contributing to heat and compress the plasma for more confined EUV emission.

In this case, the device may comprise a pulse generator connected to the electrodes that triggers an electrical discharge as the plasma plume enters the space between the electrodes.

According to a third embodiment, the device comprises discharging electrodes which are arranged next to a jet target to produce a high density plasma using a conventional discharge configuration of a GDPP on the path of the plasma, a laser source which irradiates said plasma in a way which sustains the emission of EUV radiation, and a means to trigger the laser pulses when the pinch process makes the plasma dense enough to allow additional laser heating.

The device may further comprise a second vacuum chamber that is connected to the first vacuum chamber via an orifice for receiving the unused target material downstream the emission zone of EUV light.

BRIEF DESCRIPTION OF THE DRAWINGS

The invention will now be described for the purpose of exemplification with reference to the accompanying schematic drawings, which illustrate preferred embodiments and in which.

DESCRIPTION OF THE PREFERRED EMBODIMENTS

According to the invention it is recognized that the above mentioned disadvantages for X-ray sources generated by either sole laser generated scheme or sole discharge generated scheme alone can be avoided by utilizing a specific synergistic combination of both concepts which may comprises various hybrid source embodiments.

Figure 1A:
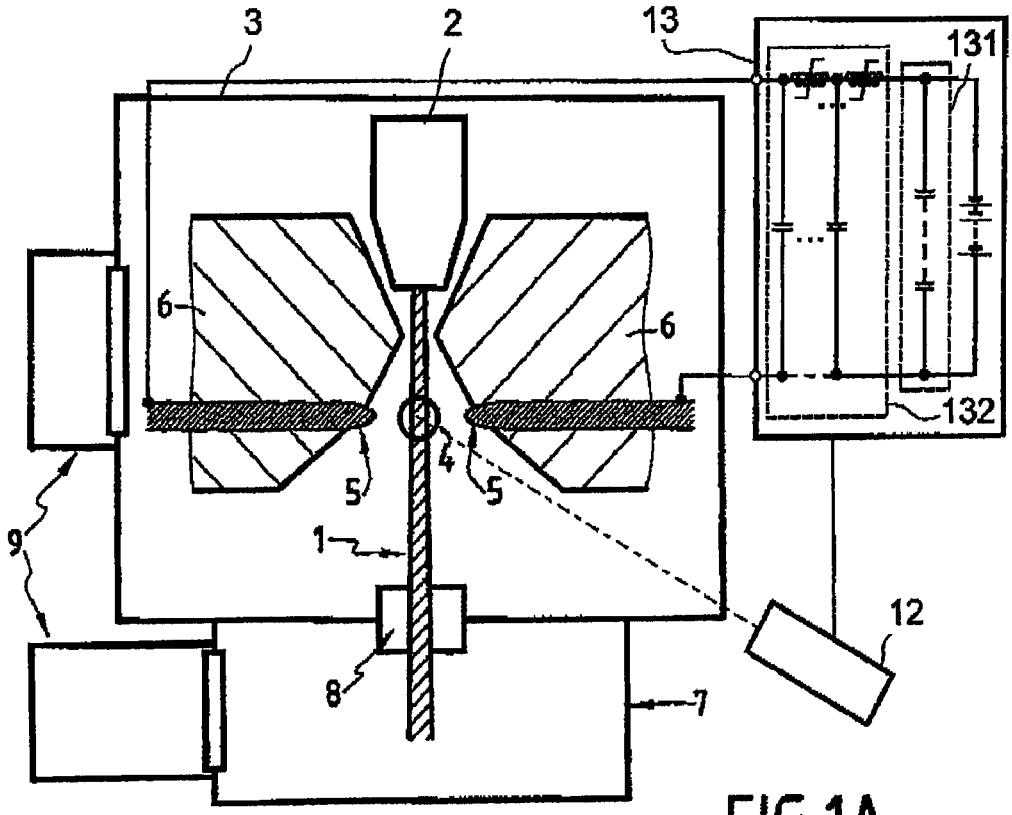
FIG. 1A is a schematic view of a particular embodiment of the invention where the discharge is ignited and confined by a laser produced plasma using a cold droplet spray target.
Figure 1B:
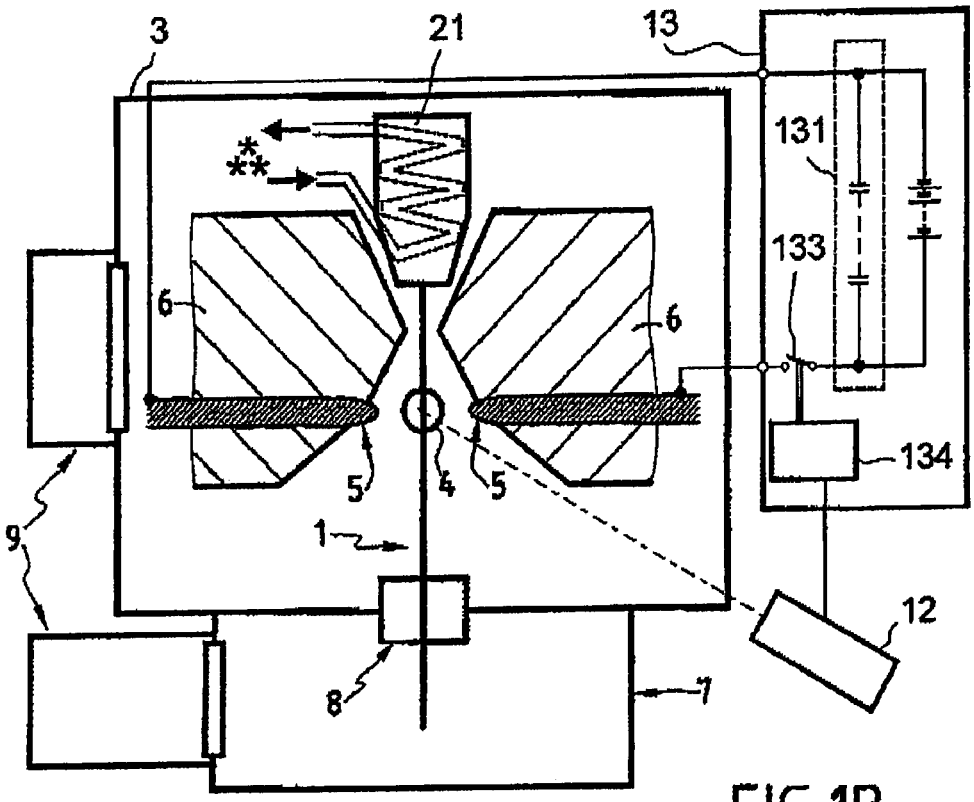
FIG. 1B is a schematic view of the particular embodiment of FIG. 1A but with another type of jet target (micro-liquid jet)
Figure 2:
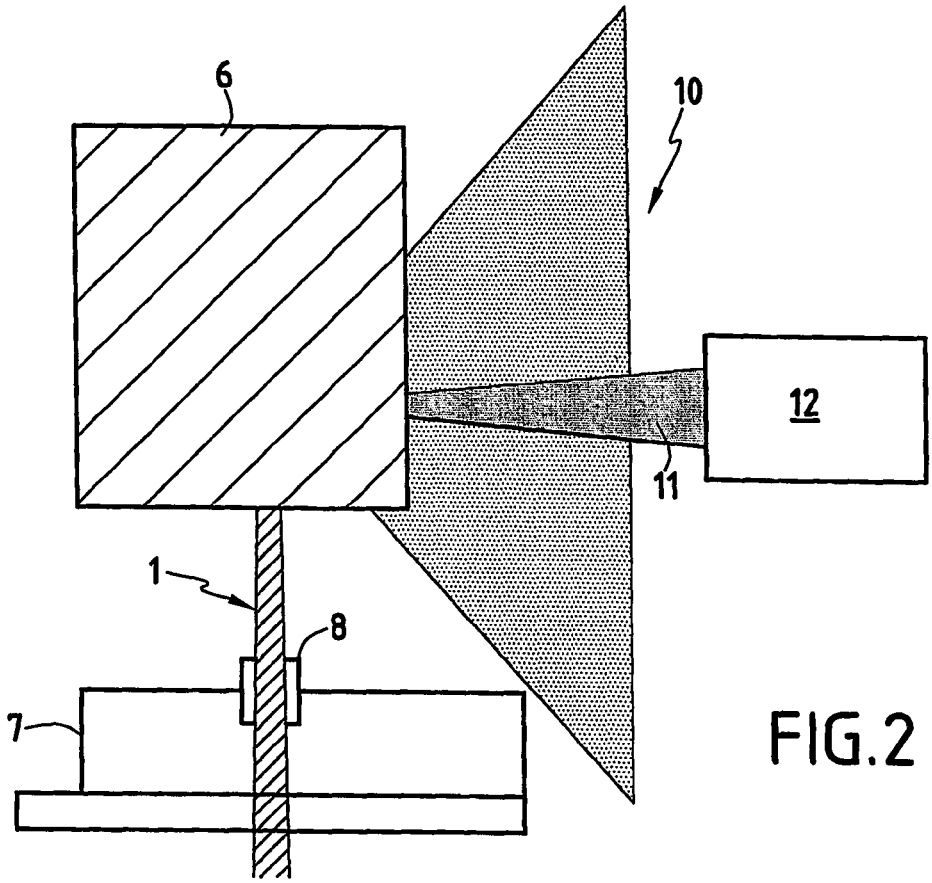
FIG. 2 is a schematic side-view of the embodiment of FIG. 1A showing the laser beam focused on an interaction zone and the produced useful EUV radiation emitted into a large zone.

FIGS. 1A, 1B and 2 relate to a first embodiment which may be designated as a discharge boosted laser produced plasma source (DBLPP).

According to the first embodiment of the invention, the device for generating extreme ultraviolet (EUV) or soft X-ray radiation comprises a laser source for producing a laser radiation which is focused to intensities beyond 106 W/cm2 onto a dense target to produce a plasma, and electrodes located around the path of the plasma produced by the laser source, the electrodes being combined with means for producing a rapid electric discharge in the plasma with a characteristic time constant which is less than the time constant of the laser produced plasma expansion time (case of DBLPP device).

The invention in this preferred form operates in the following way: a cold (i.e. liquid or solid) jet target, a spray target, a cluster target or an effusive gas target 1 is injected by a nozzle or another similar apparatus 2 into a first vacuum chamber 3 which is used as an interaction chamber. The laser interaction zone 4 on the target is surrounded by electrodes 5 which are held by some electrically insulating block 6, and constitute a discharge unit. The electrodes are arranged in either a Z-pinch, hollow cathode pinch, star pinch, or capillary discharge configuration. The electrically insulating block 6 which is preferably cryogenically cooled and presents a high thermal conductivity, thereby allows evacuating the heat load produced by absorption of both unused in-band and out-of-band radiation. This block 6 also acts as a heat shield for a possible cryogenic target injector 21. The jet target enters a second vacuum chamber 7 that is connected to the first vacuum chamber 3 via an orifice 8. The laser impact on the target 1 in the interaction zone 4 produces a plasma (either emitting EUV radiation or not) that triggers a discharge (which means that the discharge power supply 13 not necessarily need an own trigger unit). Useful EUV light can be collected in a large cone having its symmetry axis perpendicular to the drawing plane of FIG. 1A and pointed towards the reader. This large cone 10 can be seen on FIG. 2 which is a side view of FIG. 1A and shows the laser beam 11 generated by a laser source 12 and focused on the interaction zone 4, as well as the produced useful EUV radiation which is emitted to the right into a large cone 10.

The current pulses that flow from electrodes 5 in the presence of a plasma in the interaction zone 4 are provided by the rapid discharge of capacitively stored energy.

The rapid discharge may be produced by the electrode system 5 which is directly connected to a capacity bank 131.

Alternatively, the rapid discharge may be achieved through a power on-off switch 133 which is switched on by a logic control element 134 and is connected between the electrodes 5 and the capacity bank 131.

The voltage applied to the electrodes 5 is higher than the ignition voltage of the gas discharge at the considered pressure.

The current pulses provided by the electrodes 5 are switched in a defined temporal relation with the firing of the laser pulse.

The time constant of the LPP expansion time exceeds the characteristic time constant of the discharge.

The synchronization between laser and discharge is implicitly controlled by the laser source 12.

The capacitively stored electrical energy is connected to the preferred discharge path with such low inductance that the discharge time is longer than 100 ns and preferably shorter than 200 ns (i.e. is preferably between 100 and 200 ns).

The device for generating extreme ultraviolet (EUV) or soft X-ray radiation by using an hybrid combination of laser produced and discharge produced approach is advantageous for generating short wavelength radiation in the sense that a large portion of the driving power is cheap electrical power and that the laser plasma enables the discharge to occur at higher densities and/or more confined than possible with discharges alone, and that the laser plasma induces the discharge to occur at larger distances from the electrodes to avoid corrosion and to limit the heat load.

FIG. 1B merely shows a cold jet target which may be obtained as defined in above-mentioned document WO 02/085080.

Figure 3:
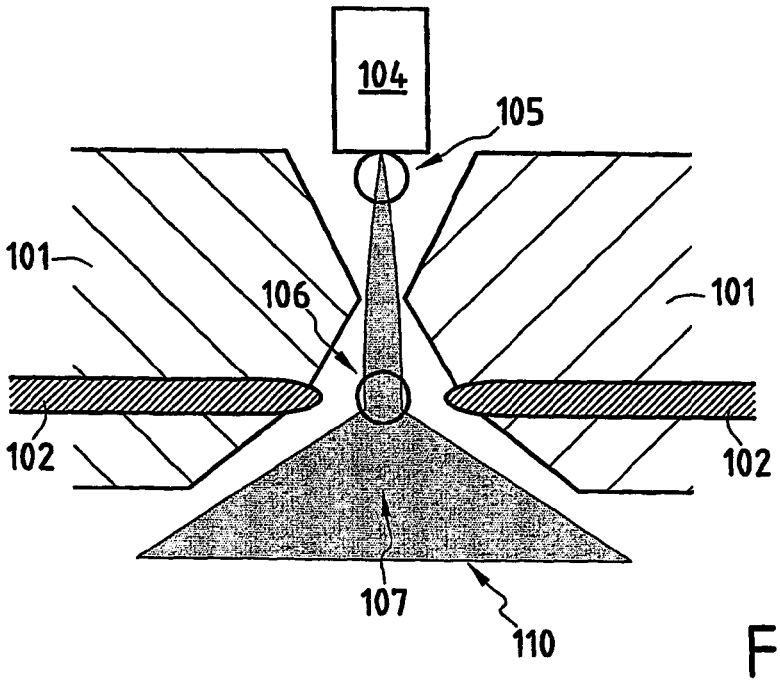
FIG. 3 is a schematic view of a particular embodiment for a laser-assisted discharge source (LAGDPP) according to the invention.

FIG. 3 illustrates a second embodiment of the present invention and is seen in a view which is similar to FIG. 1A and FIG. 1B. The laser source and the laser beam are thus not shown on FIG. 3 but are similar to the laser source 12 and the laser beam 11 of FIG. 2.

However, FIG. 3 shows a solid target 104, a laser spot 105 where the laser beam hits the solid target 104 and provides the ablation of the target 104 and a delocalised interaction zone 106 which constitutes the actual EUV source and where the electric discharge takes place from electrodes 102.

The electrodes 102 are mounted in electrically insulated block 101 which is similar to the block 6 of FIGS. 1A and 2.

Reference 107 relates to the plasma plume and reference 110 relates to the useful EUV radiation which is emitted in a large cone.

FIG. 3 illustrates the so-called laser-assisted gas discharge produced plasma (LAGDPP) where a cold plasma is generated by a laser pulse (zone 105). The subsequent discharge through electrodes 102, which uses the laser produced plasma as a discharge channel, heats and compresses this plasma for more efficient and more confined EUV emission (zone 106).

According to the second embodiment of the invention, the device for generating extreme ultraviolet (UEV) or soft X-ray radiation comprises a laser that evaporates a solid or liquid target to produce a cold plasma plume, discharging electrodes which are arranged on the path of the plasma plume, and a pulse generator connected to the electrodes that triggers an electrical discharge as the plasma plume enters the space between the electrodes, the discharge contributing to heat and compress the plasma for more confined EUV emission.

More generally, in the LAGDPP concept, the invention uses a laser that evaporates a solid or liquid target material (for example tin or lithium or others) which is used as the active material of the gas discharge produced plasma, also possibly supported by one or more buffer gases. As soon as the plasma plume 107 enters the space between the electrodes 101, a discharge is actively triggered. The useful EUV radiation is emitted preferably in a large cone 110. The conversion efficiency of the LAGDPP gas discharge plasma with tin, for example, reaches more than 1.3% (2% in-band EUV radiation to electrical input energy for the discharge plasma).

In the first embodiment of the present invention (DBLPP), the laser generates a high density plasma of small extension and uses the cheap discharge energy for a) heating the plasma for achieving emission over a longer period of time (resulting in a strongly increased duty cycle of the EUV source), b) keeping the plasma confined for effective emission over a longer period of time.

In addition, DBLPP allows for: a) initiating the discharge in a way that the discharge occurs already at high densities and in a smaller volume, b) forcing the gas discharge produced plasma to occur far from the electrodes and other hardware to avoid erosion.

According to the third embodiment of the invention, the device for generating extreme ultraviolet (EUV) or soft X-ray radiation comprises discharging electrodes which are arranged next to a jet target similar to those used in conventional GDPP process, to produce a high density plasma using a conventional discharge configuration as in GDPP on the path of the plasma, a laser source which irradiates said plasma in a way which sustains the emission of EUV radiation, and a means to trigger the laser pulses when the pinch process makes the plasma dense enough to allow additional laser heating (case of LBGDPP device).

In the third embodiment of the invention, called Laser Boosted Gas Discharge Produced Plasma (LBGDPP), a conventional GDPP is generated which emits EUV radiation. Actively synchronised with the discharge, a laser is focused onto this plasma in order to sustain the EUV emission for a longer time or to efficiently excite radiation channels which can contribute to enhance EUV-yield. There are three main approaches to this concept, according to the required way of plasma excitation. For prolongation of the plasma emission time, intensities in the range of only $10^9$-$10^{10}$ W/cm$^2$ are needed. For opening new channels of emission, intensities in the range of $10^{12}$ W/cm$^2$ are preferred. Non-linear effects can be excited with intensities beyond $10^{14}$ W/cm$^2$.

In conclusion, several synergistic effects arise because of the hybrid-like character of the DBLPP concept in particular:

1. The process starts with a laser produced plasma that emits EUV light at 13.5 nm. Thereby, the laser plasma induces the triggering of a discharge that delivers cheap electrical energy to maintain the plasma temperature even after the laser pulse has ended. The pinch effect will then confine the plasma for a longest possible EUV emission time (time scale is much longer than the typical laser pulse duration).

2. Due to the preformed LPP plasma, the GDPP can be operated with much longer plasma-electrode distances without important spatial jitter (that is defined by the stability of the laser focus). In addition, the DBLPP will maintain the characteristic plasma size of the preceding LPP plasma. Finally, because of the strongly confined and cold laser target (GDPP will not work with acryogenically cooled target or a solid-for this reason, in the LAGDPP concept a laser is used to prepare the target for the subsequent GDPP), the residual gas pressure around the laser focus and between the discharge electrodes is very low. The situation forces the discharge spark to go exactly through the preformed laser produced plasma. Thus, the position of the laser focus always defines the path of the spark line. (This is in contrast to earlier experiments on laser-triggered discharges where the whole chamber is filled by a gas. As a result, the laser-triggered discharge follows a random sparkline).

3. The preformed LPP allows for confinement by magnetic fields before the discharge itself is occurring.

For optimum operation of hybrid source concepts, the synchronization between laser and discharge can either be actively controlled (LAGDPP and LBGDPP) or can even occur spontaneously (DBLPP). Compared to GDPP concepts, the absolute time jitter of EUV emission is much lower since it is controlled in situ by the production of the laser plasma and not necessarily by some external electrical power supply.

While the foregoing description and drawings represent the present invention, it will be obvious to those skilled in the art that various changes may be made therein without departing from the true spirit and scope of the present invention.

What is claimed is:

1. A method for generating extreme ultraviolet (EUV) or soft X-ray radiation comprising the steps of:

generating and heating a plasma in a hybrid manner by the combination of a laser radiation produced by a laser source which is focused to intensities beyond $10^6$ W/cm$^2$ onto a target and of an electric discharge produced by electrodes combined with means for producing a rapid electric discharge; and providing that the time constant of the laser produced plasma expansion time exceeds the characteristic time constant of the discharge.

2. The method according to claim 1;

wherein the target is a gaseous, liquid, liquid spray, cluster spray or solid medium, such as a bulk or foil target, more than $10^{19}$ atoms/cm$^3$.

3. The method according to claim 1;

wherein a EUV plasma is first produced by the laser radiation focused on a dense target in a laser interaction zone and subsequently a discharge is induced across the laser interaction zone thereby boosting the initial laser produced plasma and enhancing total EUV light production.

4. The method according to claim 1;

wherein a cold plasma is generated by the laser radiation focused on the target to produce a cold plasma plume, and a discharge is then actively triggered in a delocalized interaction zone of the plasma plume to heat and compress the plasma for more confined EUV light emission.

5. The method according to claim 1;

wherein an EUV plasma is first produced by use of a conventional electrical discharge configuration, and subsequently, during a pinch process of the discharge when the plasma becomes sufficiently dense, laser radiation is focused on that high density discharge plasma thereby boosting the initial discharge produced plasma and enhancing the EUV light production.

6. The method according to claim 1;

wherein the current pulses that are applied in the presence of plasma by the electrodes are provided by the rapid discharge of capacity stored energy.

7. The method according to claim 1;

wherein the current pulses that are applied in the presence of plasma by the electrodes are selected with a period within a one-to-three digit nanosecond range.

8. The method according to claim 1;

wherein the current pulses that are applied in the presence of plasma by the electrodes are selected with amplitudes in a two-to-three digit kilo-ampere range.

9. The method according to claim 1;

wherein the current pulses that are applied in the presence of plasma by the electrodes are switched in a defined temporal relation with the firing of the laser pulses produced by the laser source.

10. The method according to claim 1;

wherein the plasma produced has a temperature in the six-digit Kelvin range.

11. The method according to claim 1;

wherein the plasma is generated with gas pressures selected in the range below 10 Pa.

12. The method according to claim 1;

wherein the plasma emits radiation with wavelengths shorter than 50 nm.

13. The method according to claim 1;

wherein the target is chosen from the following materials: xenon, tin, copper, lithium, oxygen, and iodine.

14. A device for generating extreme ultraviolet (EUV) or soft X-ray radiation comprising:

a laser source for producing a laser radiation which is focused to intensities beyond $10^6$ W/cm$^2$ onto a target to produce a plasma; and electrodes located around the path of the plasma produced by the laser source;

wherein said electrodes are combined with means for producing a rapid electric discharge in the plasma with a characteristic time constant which is less than the time constant of the laser produced plasma expansion time.

15. The device according to claim 14;

wherein the means for applying electrical energy comprises a pulse compressor.

16. A device according to claim 14;

wherein the means for storing electrical energy comprises a capacity bank.

17. The device according to claim 14;

wherein the electrodes are connected directly to the capacity bank to produce said rapid electric discharge.

18. The device according to claim 14;

wherein the electrodes are connected to the capacity bank through a power on-off switch which is switched on by a logic control element to produce said rapid electric discharge.

19. The device according to claim 14;

wherein the discharge time between the electrodes is between 100 ns and 200 ns, and the laser pulse duration of the laser pulses generated by the laser source is a few nanoseconds and does not exceed 60 ns.

20. The device according to claim 14, further comprising:

a nozzle for injecting a cold jet target, a micro-liquid jet, a droplet spray target, a cluster jet target or an effusive gas target into a joint vacuum chamber equipped by at least one electrically insulating block to hold the electrodes around a laser interaction zone of the target.

21. The device according to claim 20;

wherein said device further comprises a second vacuum chamber that is connected to the first vacuum chamber via an orifice for receiving the unused target material downstream the EUV light emission zone.

22. The device according to claim 20;

wherein the electrodes are arranged in either a Z-pinch, hollow cathode pinch, star pinch, or capillary discharge configuration.

23. The device according to claim 14;

wherein the electrically insulating block has a high thermal conductivity.

24. The device according to claim 23;

wherein the electrically insulating block is cryogenically cooled and allows evacuating the heat load produced by absorption of both unused in-band and out-of-band radiation.

25. The device according to claim 23;

wherein the electrically insulating block also acts as a heat shield for a cryogenic target injector.

26. The device according to claim 14;

wherein the target onto which the laser source is focused is a dense target.

27. The device according to claim 14;

wherein a laser beam produced by the laser source irradiates a solid bulk, solid foil, liquid, spray, cluster, or effusive gas target to produce a cold plasma plume; and wherein the discharging electrodes are arranged on the path of the plasma plume with the laser interaction zone, the discharging electrodes contributing to heat and compress the plasma for more confined EUV emission.

28. The device according to claim 27, further comprising:

a pulse generator connected to the electrodes that triggers an electrical discharge as the plasma plume enters the space between the electrodes.

29. The device according to claim 14, further comprising:

discharging electrodes which are arranged next to a jet target to produce a high density plasma using a conventional discharge configuration of a GDPP on the path of the plasma;

a laser source which irradiates said plasma in a way which sustains the emission of EUV radiation; and a means to trigger the laser pulses when a pinch process makes the plasma dense enough to allow additional laser heating.

* * * * *